US005862937A

United States Patent [19]

Carrizales et al.

[11] Patent Number: 5,862,937

[45] Date of Patent: Jan. 26, 1999

[54] FOOD AND BEVERAGE CHILLING SYSTEM

[75] Inventors: David A. Carrizales, Burleson; Thomas A. Chambers, III, Arlington, both of Tex.

[73] Assignee: Inventures, Inc., Fort Worth, Tex.

[21] Appl. No.: 685,483

[22] Filed: Jul. 24, 1996

[51] Int. Cl.[6] ..... B65D 1/24

[52] U.S. Cl. ..... 220/501; 220/506; 206/0.5

[58] Field of Search ..... 206/0.5; 220/411, 220/501, 506

[56] References Cited

U.S. PATENT DOCUMENTS

| | | | |
|---|---|---|---|
| 592,781 | 11/1897 | Hertwig | 220/506 |
| 664,117 | 12/1900 | Bates | 220/506 |
| 1,576,955 | 3/1926 | Dubraks | 220/506 |
| 2,204,765 | 6/1940 | McDaniels | 220/506 |
| 3,470,929 | 10/1969 | Thornton | 220/506 |
| 4,567,675 | 2/1986 | Rennie | 206/0.5 |
| 4,809,522 | 3/1989 | deNevers et al. | 62/457 |
| 4,813,174 | 3/1989 | Cook | 206/0.5 |
| 4,821,630 | 4/1989 | Roberts | 206/0.5 |
| 4,823,974 | 4/1989 | Crosser | 220/85 |
| 4,870,837 | 10/1989 | Weins | 62/457.4 |
| 4,892,215 | 1/1990 | Carlson et al. | 220/69 |
| 5,465,521 | 11/1995 | Baker et al. | 206/0.5 |

*Primary Examiner*—Joseph M. Moy

*Attorney, Agent, or Firm*—William D. Jackson; Locke Purnell Rain Harrell, P.C.

[57] ABSTRACT

A canister adapted to receive food or a beverage container for insertion into a chilling vessel such as an ice bucket comprising a sleeve member and a base member adapted to support the canister within an appropriate chilling vessel. The base member has a transverse portion extending outwardly from the periphery of the sleeve member which extends upwardly from the base member and has an open upper end through which food or a beverage container can be inserted and withdrawn. The sleeve is provided with a cap having a transverse closure member at least partially closing the upper end of the sleeve and a downwardly depending skirt which is configured to fit around the upper periphery of the sleeve member in order to hold the cap member in place on the sleeve. At least one flow channel provides for fluid communication between the exterior and interior of the canister. The cap member has a central aperture to accommodate the insertion of a wine bottle or the like and is configured to provide a plurality of slots which extend radially outwardly from the central aperture in a spoke-like configuration and to divide the cap into a plurality of flexible segments. The canister is configured to provide an internal upstanding support near the bottom thereof extending upwardly into the interior of the sleeve to provide a clearance space between the bottom of the container and the bottom of the canister.

21 Claims, 11 Drawing Sheets

FOOD AND BEVERAGE CHILLING SYSTEM

FIELD OF THE INVENTION

This invention relates to chilling systems for food or beverage containers, such as wine bottles and the like, and more particularly to such systems for facilitating chilling in the presence of a cooling medium, such as chipped ice.

BACKGROUND OF THE INVENTION

It is well known in the art to provide systems for chilling wine and other beverages to maintain the wine at a suitable temperature for serving. One of the simplest and best known procedures for accomplishing such chilling operations is through the use of a "wine bucket" within which a bottle of wine is surrounded by chipped ice to keep the wine cool for a suitable period of time, such as in the course of a dinner. In the past, various procedures have been proposed to overcome disadvantages associated with the use of a conventional ice bucket. As disclosed in U.S. Pat. No. 4,823,974 to Crosser, there are provided containers of generally cylindrical configurations designed to store one or more beverage containers in a thermally-insulated liner which is filled with crushed ice. In its simplest configuration, the Crosser system comprises a thermally-insulated cylinder, such as "Styrofoam" foamed plastic, within which a wine bottle fits with a clearance providing an annular space between the inner wall of the insulated cylinder and the wine bottle. This annular space is filled with crushed ice, and a resilient wedge-shaped sealing member is then put in place around the shoulder of the wine bottle to hold it in place. A cap closure then fits into the sealing member by a friction fit to cover the top of the wine bottle. Rather than frictional engagements between the sealing member and the cylinder and also the protective cap, these members can be threadibly engaged.

Another embodiment disclosed in the patent to Crosser incorporates a block of insulated plastic material having a plurality of recesses into which beverage containers can be fitted and surrounded with ice. Alternative configurations of chilling cylinders disclosed in Crosser include those shaped generally to conform to drinking glasses, such as pilsner glasses used for beer.

Another type of system in which the wine bottle or other beverage container can be withdrawn from the ice bucket is disclosed in U.S. Pat. No. 4,870,837 to Weins. The Weins system is designed to enable a conventional ice bucket to be dispensed with in its entirety in order to avoid stated disadvantages associated with its use. The Weins system incorporates the use of a chilling vessel material having a high heat capacity, thus enabling the vessel to be pre-cooled after which a wine bottle is put in place within the vessel. Consistent with the objective of avoiding moisture within the interior of the vessel, an insulating material, such as cork or the like, is placed on the bottom of the vessel in order to reduce the likelihood that condensation will collect to the bottom of the vessel. In the event the moisture should, nevertheless, condense on the wine bottle or other container, the upper closure for the vessel is provided with an absorbent inner lining. The upper closure is segmented to provide a series of soft and flexible pie-shaped segments. This configuration limits the flow of air into the container and allows a wine bottle to be inserted into the vessel, with the closure then fitting tightly around the neck of the wine bottle, or in the case of a short beverage container, completely over the top of the beverage container. An alternative system disclosed in Weins comprises an inner side wall and a spaced-apart outer side wall with the two side walls defining a cavity which can be filled with a liquid having a melting point close to and slightly below the temperature which is desired to be maintained.

SUMMARY OF THE INVENTION

In accordance with the present invention there is provided a novel canister which is adapted to receive food or a beverage container for insertion into a chilling vessel such as an ice bucket. The canister comprises a base member which is adapted to support the canister within an appropriate chilling vessel. The base member has a transverse portion extending outwardly from the periphery of a sleeve member which extends upwardly from the base member and has an open upper end through which food or a beverage container can be inserted and withdrawn. The sleeve is provided with a cap having a transverse closure member at least partially closing the upper end of the sleeve. The cap further has a downwardly depending skirt which is configured to fit around the upper periphery of the sleeve member in order to hold the cap member in place on the sleeve. The canister configuration further comprises at least one flow channel which provides for fluid communication between the exterior and interior thereof.

In a preferred embodiment of the invention the cap closure member has a central aperture preferably having a diameter of at least two centimeters. Specifically to accommodate the insertion of a wine bottle or the like, the central aperture normally will have a diameter of about two to four centimeters. The cap closure member is further configured to provide a plurality of slots which extend radially outwardly from the central aperture in a spoke-like configuration. The slots function to divide the closure into a plurality of flexible segments, more or less pieshaped or in the form of equilateral trapezoids which accommodate the insertion and withdrawal of a beverage container. In this embodiment of the invention, the cap member preferably further comprises a plurality of peripheral apertures at the outer terminal ends of the slots. These are somewhat larger than the width of the slots but significantly smaller than the central aperture. It is further preferred that the canister configuration be provided with a plurality of flow channels. More specifically, there is provided at least one opening in the base member of the canister and further at least one opening in the side wall of the sleeve.

In yet a further embodiment of the invention the canister is configured to provide an internal upstanding support near the bottom thereof extending upwardly into the interior of the sleeve. This supports the food or beverage container inserted into the sleeve to provide a clearance space between the bottom of the container and the bottom of the canister. In the case of a canister adapted to hold a wine bottle or the like, the sleeve member will be of a generally cylindrical configuration. The base member is likewise of a generally cylindrical configuration but preferably has at least one flattened edge which can function to accommodate placement of the canister nearer to the walls of a vessel or to allow tilting of the canister when placed in vessels too short to allow vertical placement.

In a further embodiment of the present invention there is provided a combination of a beverage or food chilling system comprising a chilling vessel and a canister disposed within the chilling vessel. The chilling vessel has a bottom portion and a wall portion extending upwardly from the bottom portion so that the chilling vessel is adapted to contain a cooling medium, for example, chipped ice or the like. The canister comprises a base member, an intermediate sleeve member, as described previously, and a cap on the upper end of the intermediate sleeve member having a transverse closure member which at least partially closes the upper end of the sleeve member. The sleeve member of the canister is spaced internally from the wall of the chilling vessel to provide a clearance space between the wall of the chilling vessel and the outer periphery of the sleeve member within which the chipped ice or other cooling medium may be contained. The sleeve member is provided with a plurality of vertically-extending openings therein spaced peripherally about the sleeve member to provide for fluid communication between the clearance space and the interior of the canister.

In still another embodiment of the invention, a stem member extends downwardly from the cap into the interior of the sleeve member. The stem member is provided with at least one transverse support member which is adapted to support a beverage or food item within the canister. Here, it is preferred that the cap closure member be provided with gripping means to permit an operator to grip the cap member to permit withdrawal of the cap member together with the stem and internal support member from the canister.

DETAILED DESCRIPTION OF THE INVENTION

A preferred application of the present invention is in the provision of a wine cooling system which can be inserted into a wine cooling vessel, such as an ice bucket or the like. The system provides for the easy withdrawal and later insertion of a bottle of wine into the wine bucket without the need to make space available in the accumulation of ice after each withdrawal of the wine bottle. At the same time, the invention permits the wine bottle to be withdrawn in the manner in which the user is not exposed to cold water or condensation on the exterior of the wine bottle. As described in greater detail below, the system incorporates a rigid sleeve, usually cylindrical although it may be of another shape, which is adapted to fit into an ice bucket or an ice chest. The sleeve is provided with a cap made of flexible material. A bottle, such as a wine or large soft drink bottle, can be inserted into place to be kept cool and easily withdrawn. As will be developed below, several significant advantages derive from the use of the present invention. First, the ice is kept in place at the placement area when the bottle is removed from the ice chest or bucket, that is, the ice does not fall into the empty space previously occupied by the bottle. Secondly, the ice is prevented from becoming jammed about the bottle while at the same time permitting chill to be rapidly imparted and maintained to the beverage container.

Figure 1:
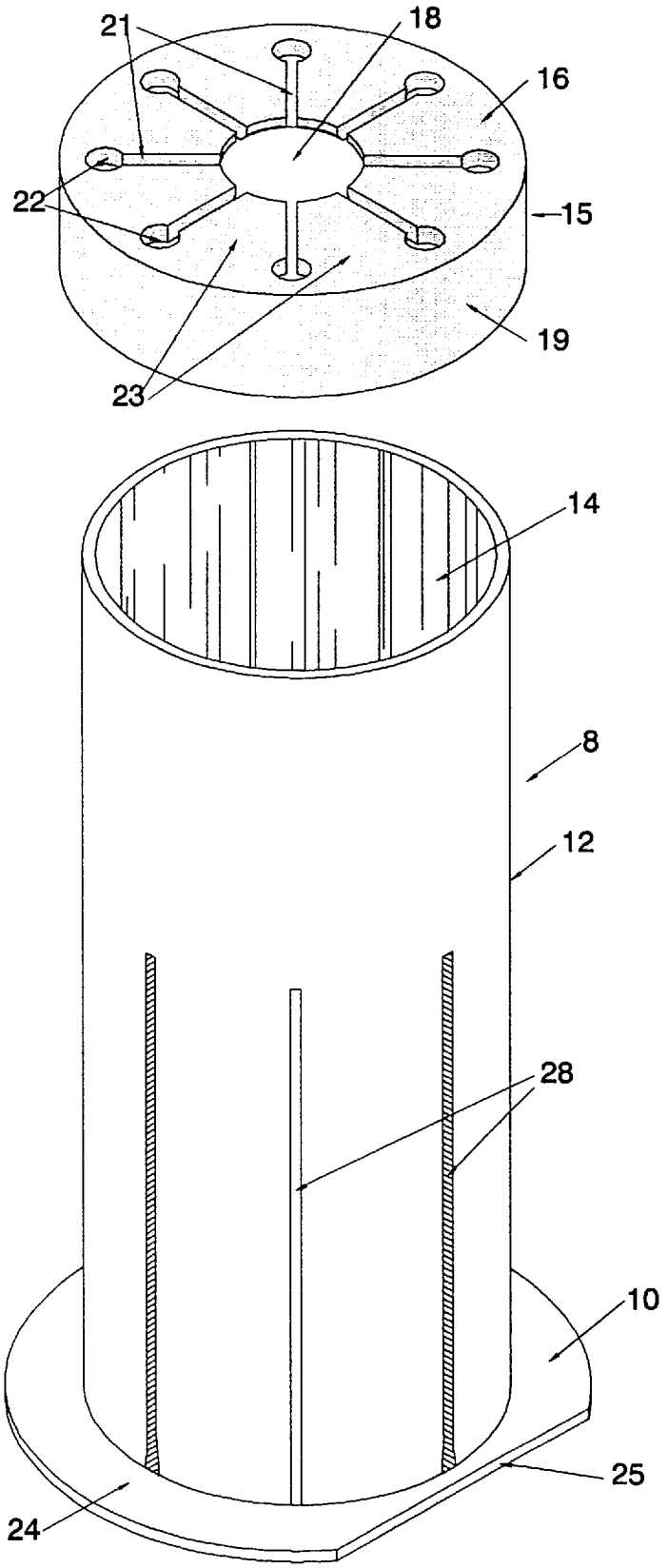
FIG. 1 is an isometric illustration showing a cylindrical canister with an associated cap member and adapted to contain a wine bottle in accordance with one embodiment of the invention.

Turning now to FIG. 1, there is illustrated an isometric view, partially exploded, of a canister 8 illustrating one embodiment of the present invention. As illustrated there, the invention involves a base member 10 from which a cylindrical sleeve member 12, in this case generally circular in cross section, extends upwardly to an open end 14. A sleeve cap 15, shown in exploded view, partially closes the upper opening of the cylindrical sleeve member to permit a wine bottle or the like to be easily withdrawn or inserted. The cap comprises a transverse closure member 16 which is provided with an enlarged central aperture 18, which is normally about two centimeters or larger, typically up to about six centimeters for most wine bottles or large soft drink containers. The sleeve further is provided with a downwardly depending skirt portion 19 which fits about the outer periphery of the cylindrical member 12 in a friction fit.

The cap member will be described in greater detail below with reference to FIGS. 3 and 4, but as shown in FIG. 1, a plurality of slots 21 extend radially outwardly from the central aperture to a location where they terminate in peripherally-spaced apertures 22 which are somewhat larger than the slots 21 but substantially smaller than the central aperture 18 of the slots. The slots 21 divide the closure member into a plurality of pie-shaped segments 23. This configuration of an enlarged central aperture, with a plurality of radially-spaced circumferential apertures with slots extending from the central aperture out to the circumferential apertures, provides a configuration in which the wine bottle or other beverage container can easily be withdrawn or inserted into place. As explained in greater detail later, as a wine bottle is withdrawn upwardly through the central aperture, the sleeve 19 is biased into a tightly-fitting conforming relationship with the upper portion of the cylindrical member.

As further shown in FIG. 1, the base member has a transverse ledge portion 24 which extends outwardly from the sleeve member. As will be appreciated, when the chilling canister is within place within an ice bucket or the like with ice surrounding the canister and resting on top of the ledge member, the weight of ice tends to hold the canister in place as a wine bottle is withdrawn through the cap member. In the preferred embodiment illustrated, the transverse ledge portion 24 of the base has one side flattened somewhat to provide an edge portion 25 which can be characterized as conforming to a chord of the circular shape generally defined by the outer perimeter of the ledge member. As further illustrated in FIG. 1, the sleeve member preferably is provided with a plurality of slots 28 which are generally dimensioned to permit fluid flow between the interior and exterior of the canister while being sufficiently small to generally block the intrusion of chipped ice into the interior of the canister.

Figure 2:
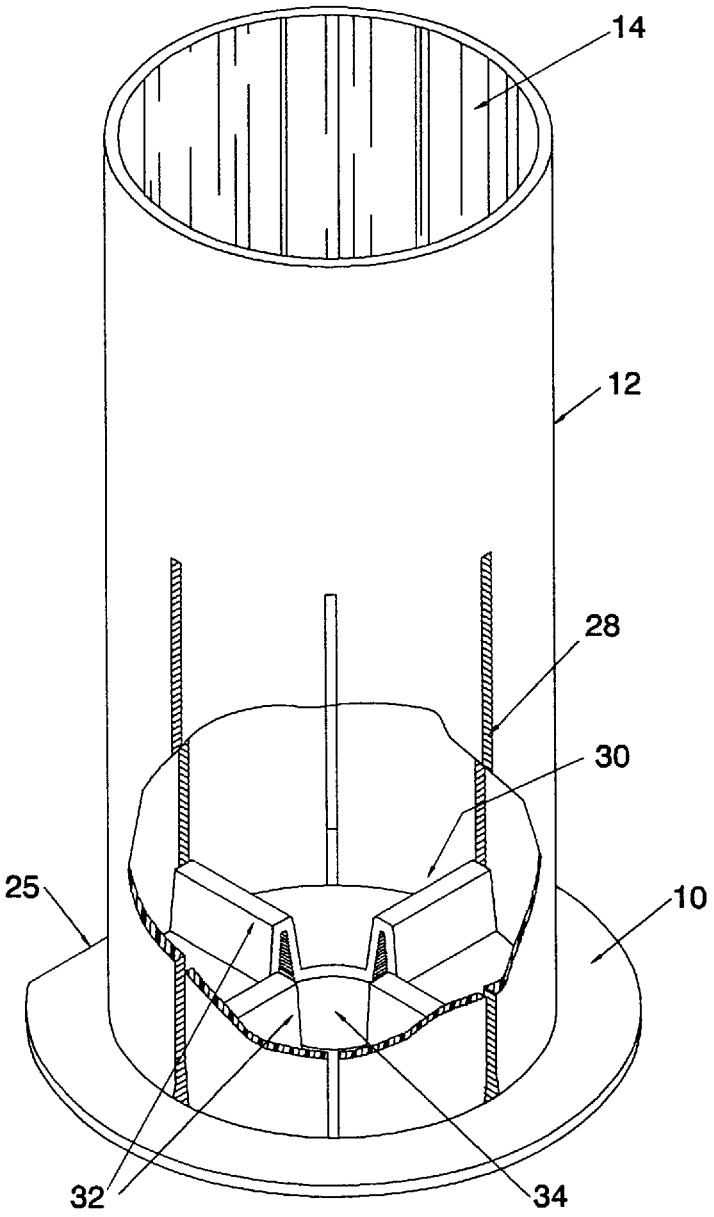
FIG. 2 is an isometric view with parts broken away showing details of certain aspects of the canister of FIG. 1.

As noted previously, the upwardly extending slots 28 in the cylindrical wall provide for fluid flow between the exterior and interior of the canister. In addition, the base member of the canister is provided with at least one opening to provide fluid communication between the interior and exterior of the canister through the bottom thereof. This feature of the invention is illustrated in FIG. 2 which is an isometric view, similar to that in FIG. 1 but with parts broken away to show detail at the bottom portion of the canister. As shown in FIG. 2, the bottom portion of the canister is configured with a plurality of spokes to provide an internal upstanding support structure 30, which functions to provide a resting place for the bottom of the wine bottle while also imparting radial rigidity to the canister, a resting place for incidental ice within the canister, and permitting an opening into the canister from the bottom thereof. More particularly in the embodiment illustrated in FIG. 2, four upstanding spokes 32 are formed integrally in the base member and extend radially from a central aperture 34 out to the interior wall of the cylindrical sleeve 12. For use with some beverage containers, such as two or three liter bottles which typically have four grooves at the bottom of the container spaced at right angles, other configurations can be used in order to ensure that the upstanding spokes do not fit into the grooves in the bottle. For example, the bottom portion of the canister can be configured with five or six spokes extending radially around the central aperture.

Figure 3:
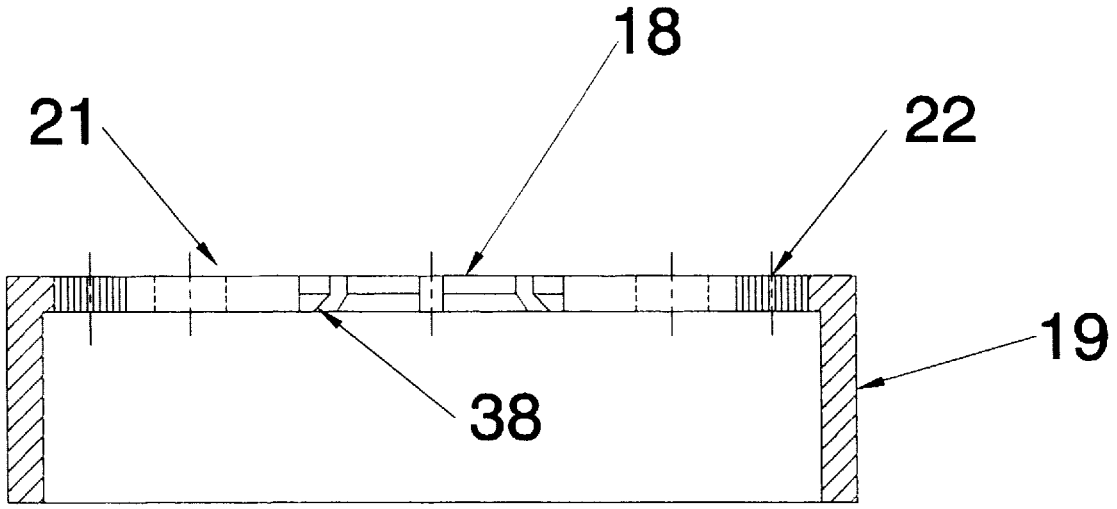
FIG. 3 is a side elevational view in section showing details of the cap member of FIG. 1.
Figure 4:
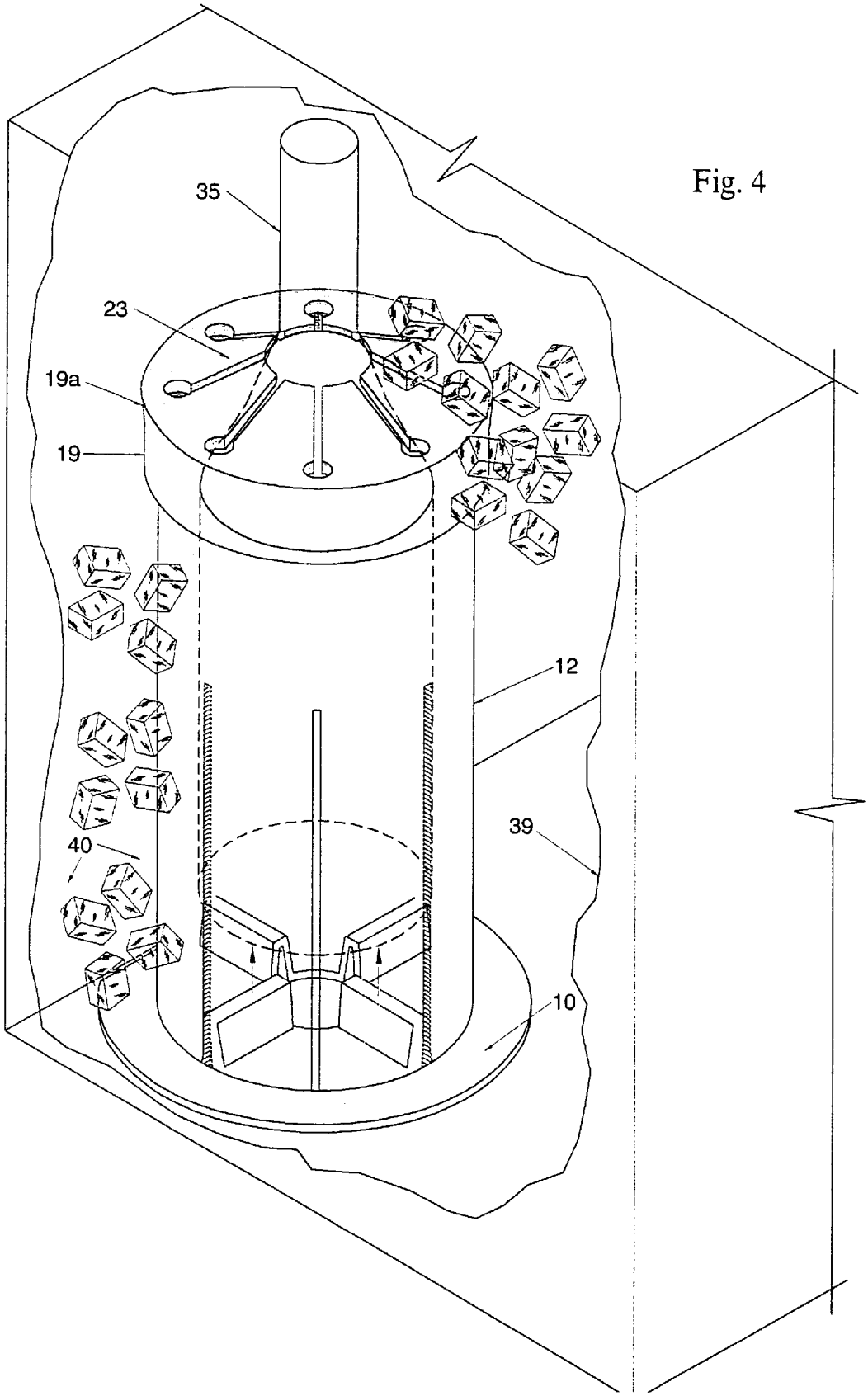
FIG. 4 is a schematic illustration with parts broken away and with parts shown in dotted lines of the canister of FIG. 1 in place within an ice bucket and containing a wine bottle.

FIG. 3 is a side elevational view of the cap member partly in section to show details of the closure member 16 and the central aperture 18. As shown in FIG. 3, the central aperture 18 in the transverse closure member is provided with a beveled edge which slants downwardly and outwardly as indicated by reference numeral 38. Surface 38 normally is beveled to provide an angle as measured from the vertical axis at the cap member of about 30°–60°, preferably about 40°–50°. The aperture may also have a corresponding bevel (not shown) adjacent to the upper side, although this usually will not be necessary. The skirt member 19 fits around the upper edge of the canister (FIG. 1 or 2) in a frictional engagement. As a wine bottle is withdrawn upwardly through the cap member, the closure member is distorted upwardly somewhat functioning not only to shed ice away from the wide bottle as it is withdrawn but also to bias the skirt member 19 inwardly against the wall of the cylindrical member to hold the cap in place. This feature of the invention is illustrated schematically in the isometric view of FIG. 4 which shows a wine bottle 35 within the canister being withdrawn upwardly through the cap member 15. The canister is shown to be in place within a chilling vessel 39, which is shown with parts broken away, and which, with the outer surface of the canister 12, defines a clearance space 40 within which ice accumulates. As shown in FIG. 4, as the wine bottle 35 is moved upwardly, the truncated pie-shaped segments 23 are, of course, flexed upwardly by the movement of the wine bottle, tending to compress the upper edge of the skirt portion 19 against the side of the cylindrical sleeve, as indicated generally by reference numeral 19*a*. At the same time, ice which may be accumulated around the neck of the wine bottle is shed away by the upwardly flexing segments. The beveled edge 38 (FIG. 3) of the central aperture functions to aid in wiping moisture off the wine bottle as well as providing a uniform flexing of segments 23.

Another embodiment of the invention involves a modified form of the cap member entailing a design in which the pie-shaped segments are tapered on the underside to a relatively thin edge at the central aperture. In addition, the underside of the cap member segments can be provided with a rib extending longitudinally along the segment from the inner wall of the skirt member to the tip of the segment. The purpose of these ribs is to provide tensile strength and rigidity to the members allowing them to spring back to a flat position after bottle insertion and to reduce the frictional contact point of the member as it is withdrawn. This eases withdrawal of the bottle from the canister and preserves the label on the bottle. As an alternative, or in addition to the ribs, the pie-shaped segments can be provided with a circular or hemispherical bead at their terminal points at the central aperture. The beads tend to ride on the bottle surface, again minimizing frictional contact of the cap member with the bottle. In addition, the skirt member can be constructed with a groove on the inner surface which mate with a corresponding rounded protrusion provided around the lip of the canister to form a relatively tight fit with the cap member. This embodiment of the invention can be employed to reduce the length of the skirt while effectively holding the cap member in place. This insures that the cap member stays in place as the bottle is withdrawn while reducing the amount of material required for manufacture of the cap member.

Figure 4A:
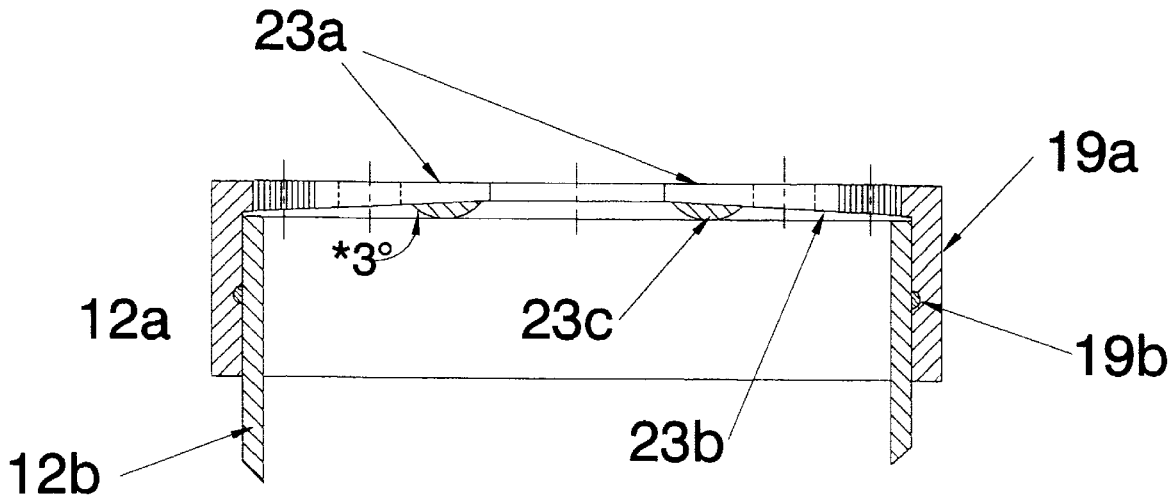
FIG. 4A is a side elevational view in section showing details of a modified form of cap member.
Figure 4B:
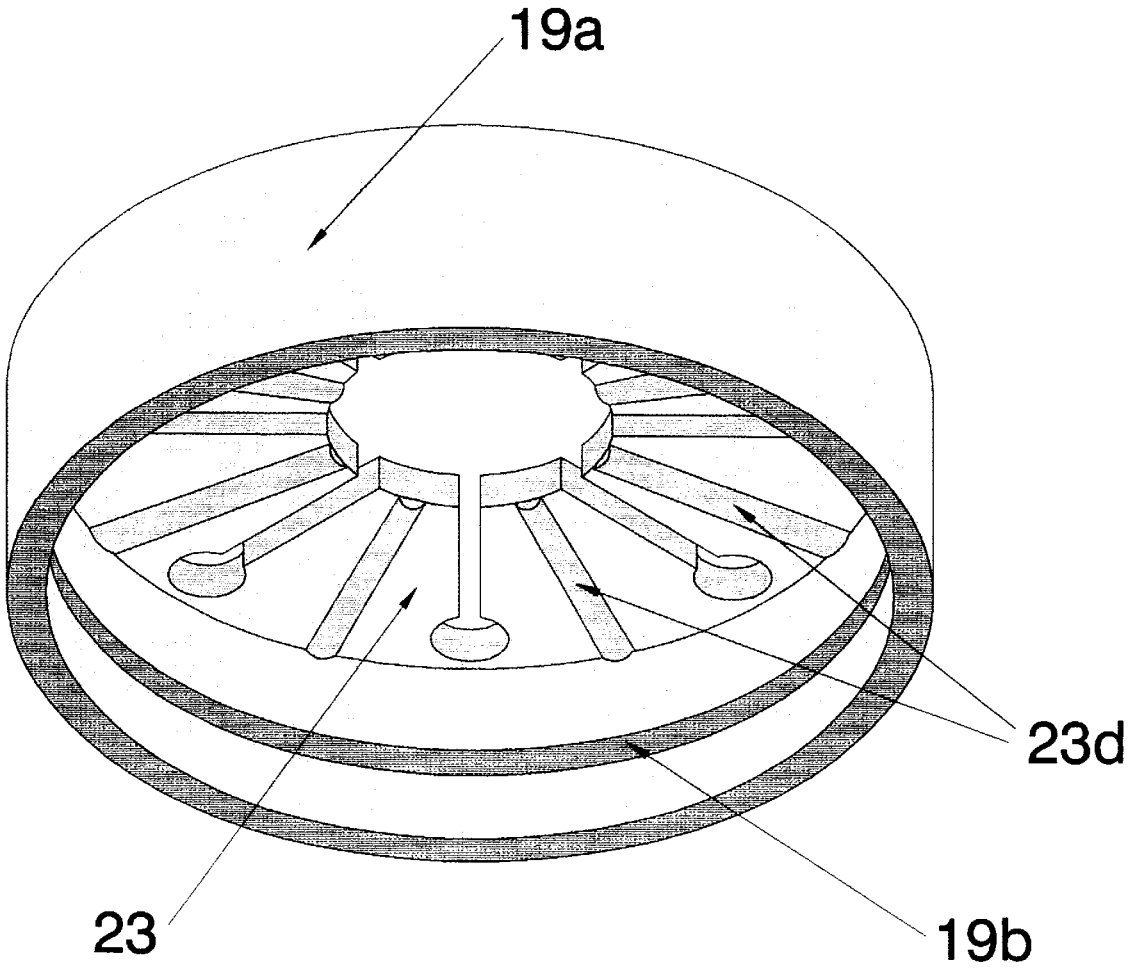
FIG. 4B is the bottom isometric view of yet another embodiment of the cap member.

These embodiments of the invention are shown in FIGS. 4A and 4B. FIG. 4A is a side elevational view, partly in section. As shown there, the indicated pie-shaped segments 23*a* have tapered bottoms 23*b* deviating from the horizontal tapered bottoms. For example, the bottom sides may have a taper of about 3° from the horizontal. The terminal points of the individual members are provided with a half-moon or hemispherical bead 23*c* at their ends, thus minimizing the area of the cap member in contact with the bottle as it is withdrawn. In addition, as shown in FIG. 4A, the skirt member 19*a* is provided with an internal groove 19*b* to fit around a corresponding annular protrusion 12*a* around the lip of a corresponding sleeve member.

FIG. 4B is a bottom isometric view of another embodiment of the invention incorporating elongated ribs as described above. Here, the underside of the pie-shaped segments 23 are provided with ribs 23*d* to provide the added rigidity as described above. The segments 23 as shown are not tapered, but they may be provided with tapered bottoms similarly as shown in FIG. 4A. The skirt portion 19*a* is provided with an internal groove 19*b*, similarly as described above with reference FIG. 4A, although it may, of course, be similar to the skirt portion shown in FIG. 3, i.e., without a groove.

Figure 5:
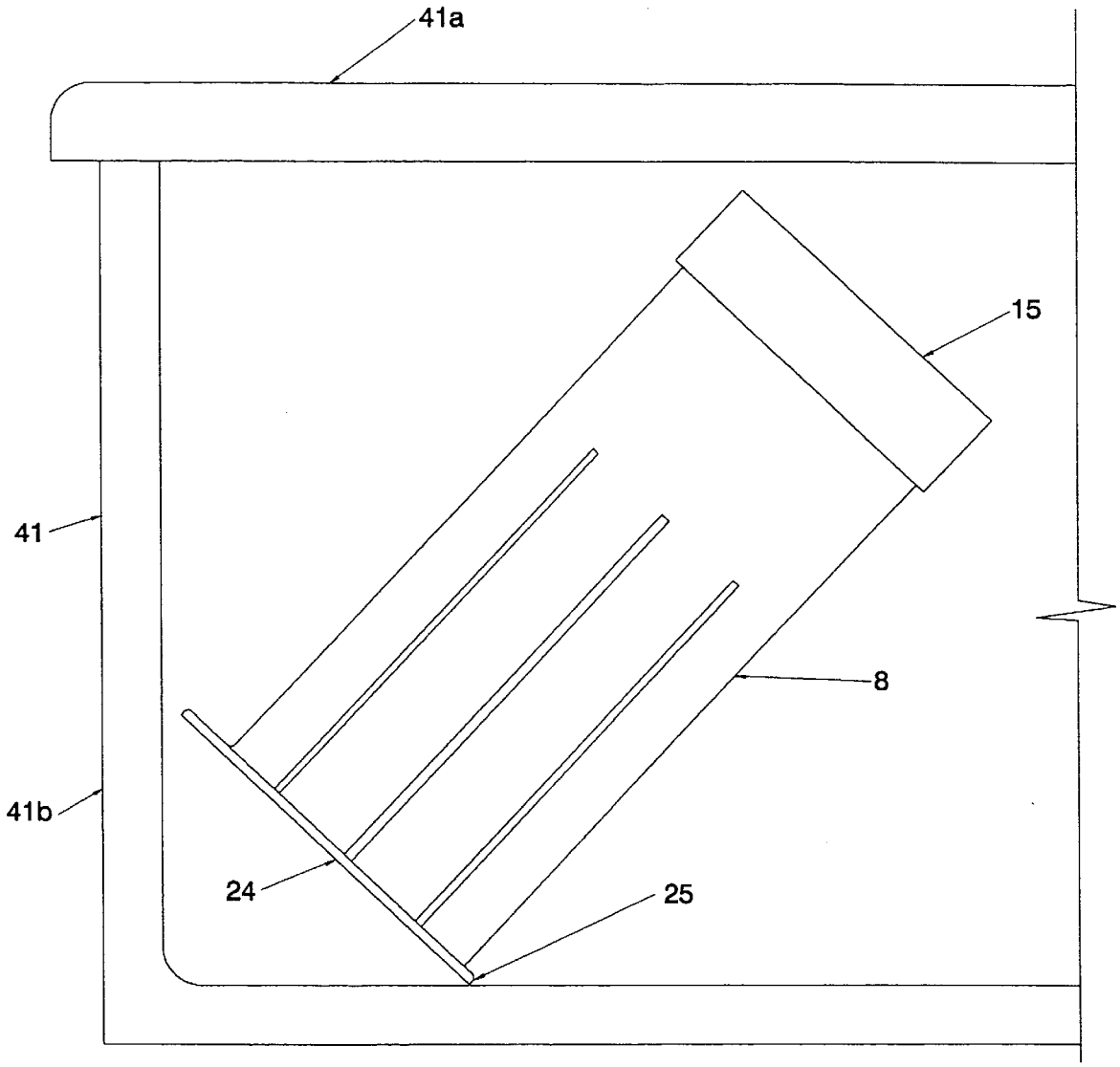
FIG. 5 is a side elevational view with parts broken away showing the function of the flat edge of the base component of the canister.

FIG. 5 is a schematic side view partly in section illustrating a canister with a flattened edge 25 positioned within a chilling vessel such as an ice chest in a canted position in which it is tilted as necessary to allow it to be placed within the vessel which is of insufficient height to permit the canister to be placed upright. As shown, the ice chest 41 is equipped with a top closure 41*a* which can be put in place so long as the canister is tipped somewhat as shown. It will be recognized that the flattened edge 25 of the base member 24 facilitates placing the beverage container in the ice chest in this position. The flattened edge can also be used to place the canister immediately next to the side wall 41*b* of the chilling bed, or two canisters, each having flattened edges as shown, can be placed side by side with the flattened edges of the base members in abutting configuration.

Figure 6:
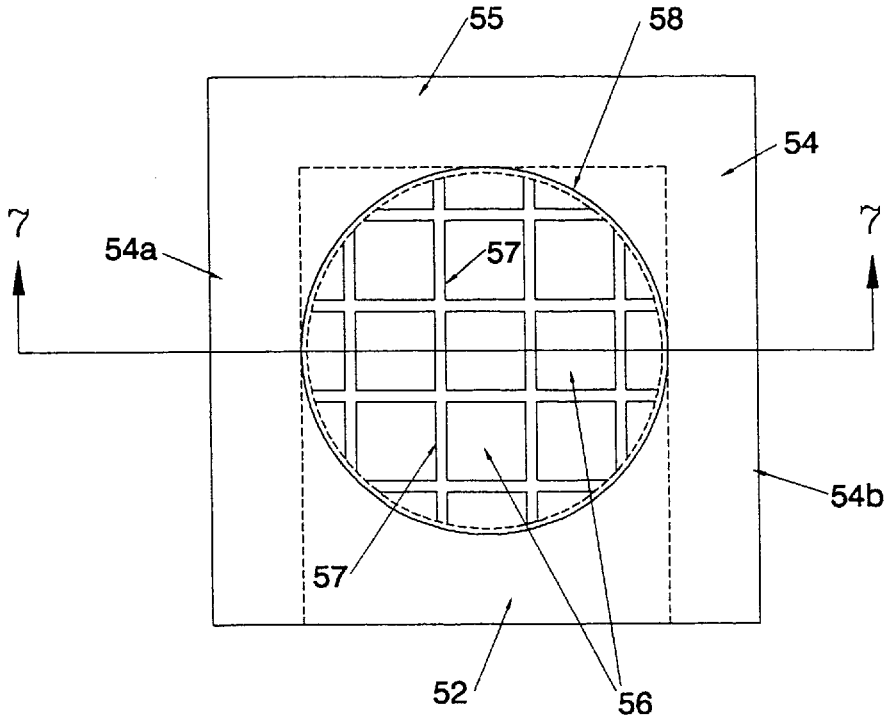
FIG. 6 is a bottom view of a canister embodying the present invention employing a modified form of base member.
Figure 7:
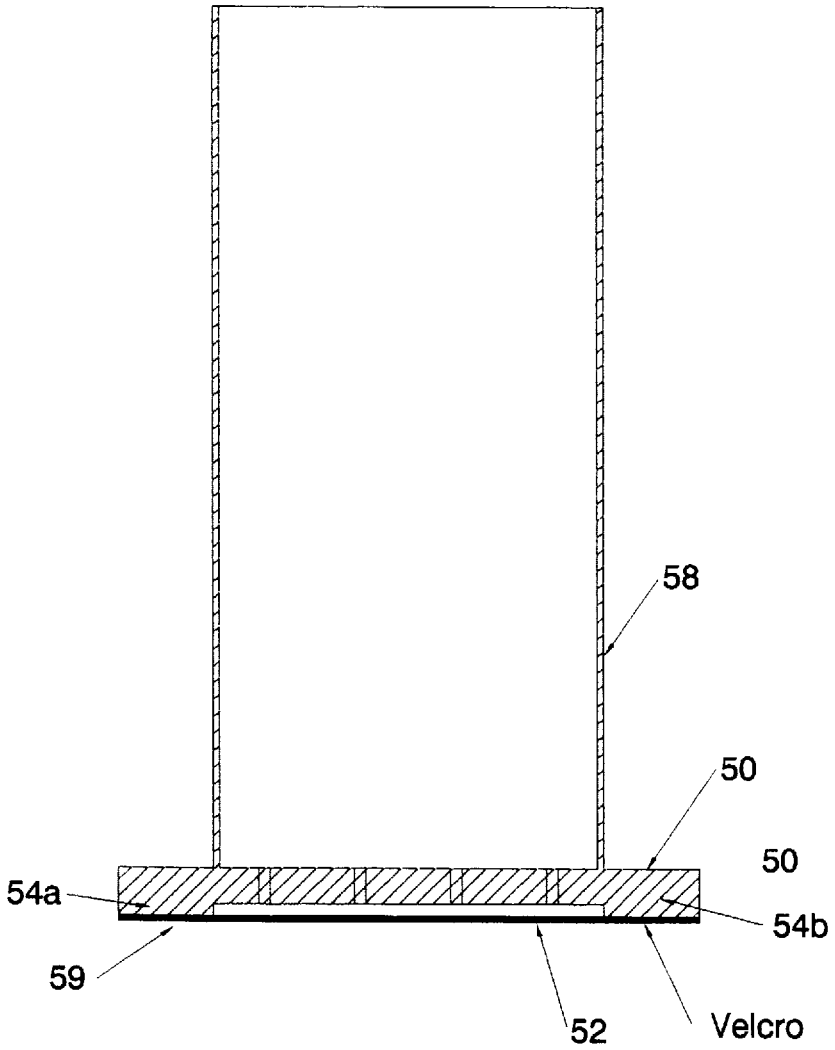
FIG. 7 is a sectional view taken along line 7—7 of FIG. 6.

Turning now to FIGS. 6 and 7, there is illustrated another embodiment of the canister of the present invention incorporating a modified form of base member 50. Here, the base member is shown to be square (although it could be generally circular or circular with a flattened edge, as described above with reference to the previous embodiment) and is provided with a transverse opening at the bottom providing a clearance space 52. The opening may extend from one side to the other but usually will extend only part way across the bottom of the base member so that the result is a more or less U-shaped abutting ledge 54 which conforms to the bottom of the chilling vessel within which the canister is inserted. This configuration is shown in FIG. 6 which is a top view of the base member. As shown, the downwardly extending ledge portion 54 is in a U-shaped support configuration having parallel legs 54*a* and 54*b* and a connecting bight portion 55 which abuts the bottom of the chilling vessel. The portion of the container of the base member is a plurality of openings 56 defined by transverse structural members 57 which provide for openings into the interior of the sleeve member 58 from the bottom. The sleeve member 58 may be solid or it may be provided with upwardly extending slots similarly as in the embodiment described previously. Preferably, in this embodiment of the invention, the bottom of the base member is provided with a fastener 59 having bottom hooked engaging members of the type identified by the term "velcro." The bottom of the chilling vessel (not shown) is likewise provided with a conforming U-shaped layer of velcro fastener which functions further to hold the canister in place within the chilling vessel.

The various component parts of the canister combination of the present invention may be formed of any suitable materials. The cap member can be formed of an elastomeric material having suitable flexibility to permit insertion and withdrawal of the beverage container. By way of example, the cap member may be formed of neoprene rubber or silicone rubber. Other elastomeric polymers may be employed, and, of course, the cap member could be formed of natural rubber. Also, deformable thermoplastic polymers, which have good flexibility although not highly elastic, can be used to form the cap member. Thus, the cap member would take the form of relatively low crystallinity polyethylene such as low-density polyethylene, and clear flexible polyvinyl chloride.

The remainder of the canister component can be formed of any suitable materials having sufficient structural strength to provide an enclosure for a wine bottle or other beverage container. Because the various openings in the sleeve and in the bottom of the base member are configured for good fluid communication to provide for the flow of cold air and liquids, cooling can be primarily by direct heat exchange. Thus, the sleeve and base member can be formed of various structural plastics as well as various metals such as stainless steel or aluminum. The sleeve and the canister preferably will have a unitary specific gravity greater than 1 in order to avoid positive buoyancy in water resulting from melting ice. Suitable plastics from which the sleeve member and base member can be prepared include, but are not limited to, polyvinyl chloride, high impact styrene, high density polyethylene, isotactic polypropylene, acrylonitrilebutadiene styrene, styrene acrylonitrile polymer, which as appropriate can, if necessary, be provided with suitable fillers such as talc in order to provide a bulk density greater than 1. The canister, the sleeve, and the base components of the canister can be molded integrally, or they can be formed separately and secured to one another by any suitable means such as structural adhesive, particularly in the case of the plastic materials. Usually it will be preferred to use plastics to form the canister of the present invention since the structural plastics usually prove to be more economical than metals such as stainless steel or aluminum. Especially in the case of those systems particularly adapted for use as food containers, as described later, structural polymer or plastics, such as polyethylene, polyvinyl chloride, polybutylene, teraphthalates, and the like, may be used.

Figure 8:
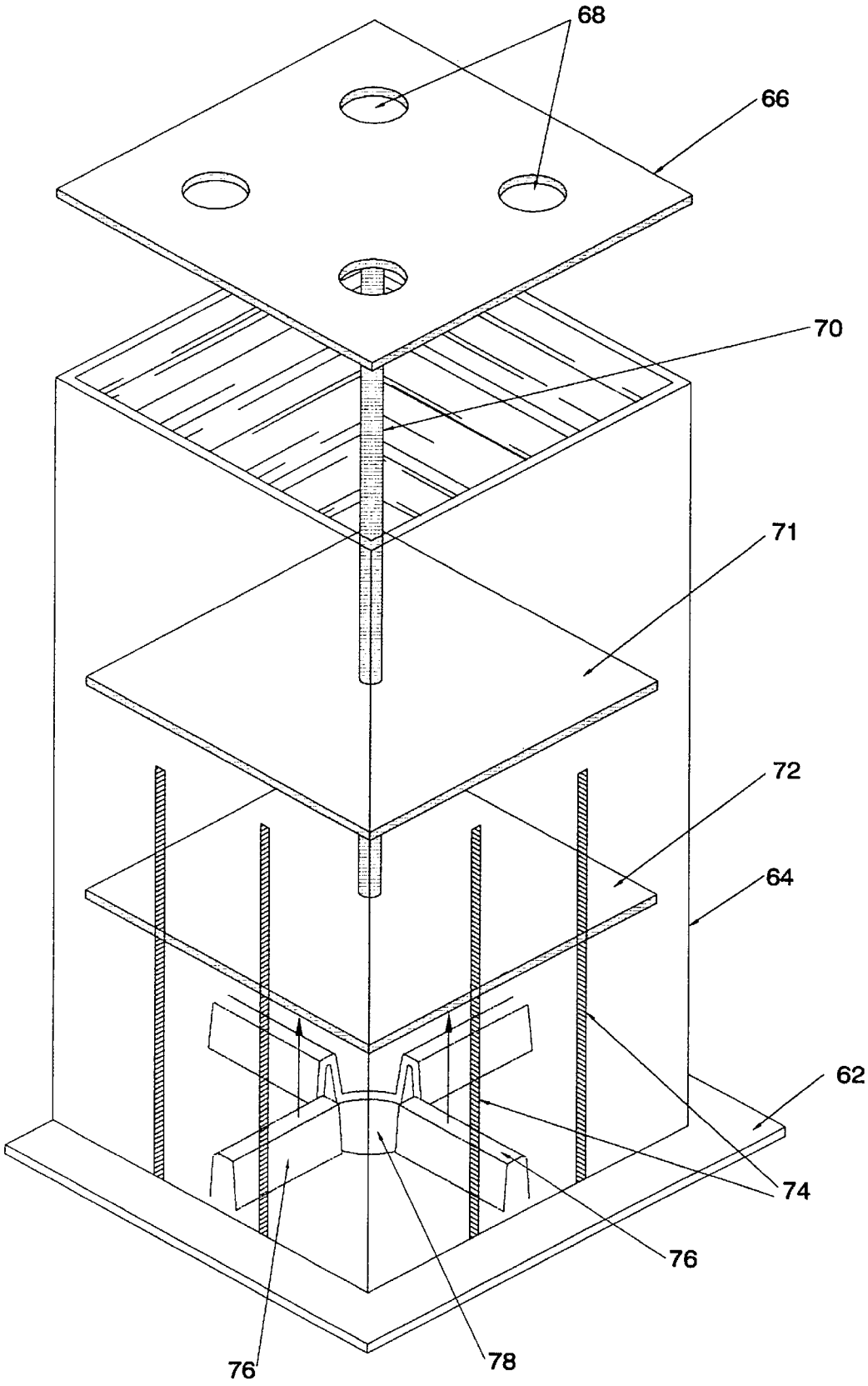
FIG. 8 is an exploded isometric view with parts broken away showing yet another embodiment of the invention.

Turning now to FIG. 8, there is illustrated a modified form of the invention incorporating one or more support members for supporting beverages or food members, such as eggs, meat, poultry, or the like, within an ice chest. In this embodiment of the invention, the cap member, which is formed of a structural plastic or the like, is provided with a stem which extends downwardly into the canister and supports one or more transverse members upon which food items and the like can rest. As shown in FIG. 8, which is an exploded isometric view with parts broken away, the canister comprises a base member 62 and an upstanding sleeve member 64. The cap 66 is formed of a structurally rigid material such as an engineering plastic and is provided with a plurality of finger slots 68. Other suitable manual gripping means can be employed; for example, the cap can be provided with one or more upstanding knobs or handles which can be grasped to permit withdrawal of the cap from the sleeve member.

In the embodiment illustrated, the sleeve member 64 and corresponding base 62 are of a rectangular configuration, e.g., the sleeve may take the form of a five-inch square cross section with the base having corresponding dimensions of six and one-half inches. The cap 66 is provided with a downwardly extending stem 70 which supports one or more, in this case two, transverse plates or support members 71 and 72. The sleeve is provided with a plurality of upwardly extending slots 74 to permit the egress and ingress of fluids. The base member is provided with transfer supports 76 and a central aperture 78 similar to the previously-described base member shown in FIG. 2.

Figure 9:
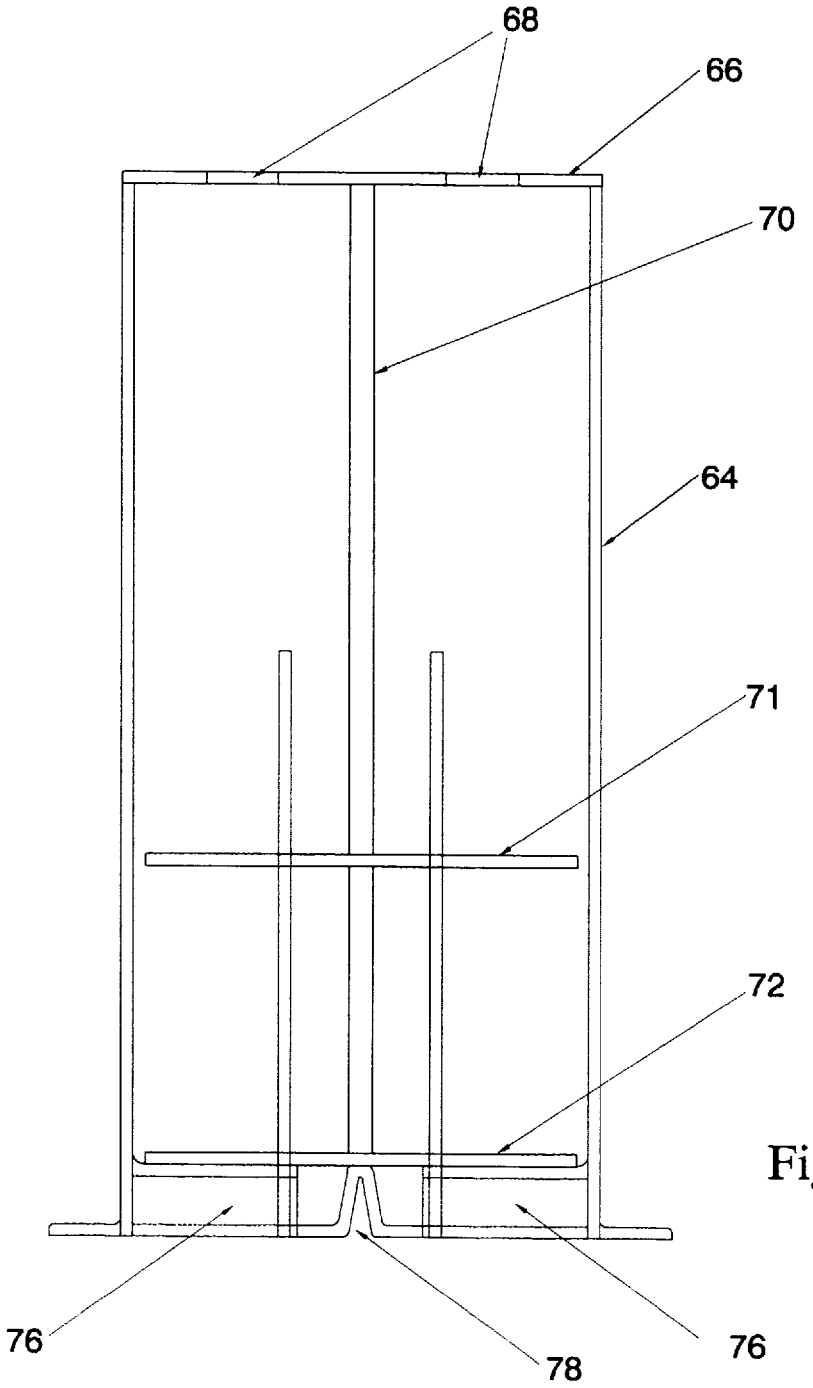
FIG. 9 is a side elevational view in section of the embodiment of the invention shown in FIG. 8.

FIG. 9 is a side elevation view in section showing the cap and downwardly extending stem 70 and support members 71 and 72 in place within the sleeve 64. As shown, the bottom transverse member 72 rests on the bottom support ribs 76 providing a space 78 below the transverse member in which incidental ice can collect. While only two interior supports 71 and 72 are shown, it will be recognized that the stem member 70 can be provided with additional transverse support members.

Having described specific embodiments of the present invention, it will be understood that modifications thereof may be suggested to those skilled in the art, and it is intended to cover all such modifications as fall within the scope of the appended claims.

What is claimed:

1. In a canister adapted to receive a beverage or food container for insertion into a chilling vessel, the combination comprising a. a base member adapted to support said canister within a chilling vessel and having a transverse ledge portion extending outwardly from the hereafter-recited sleeve member;

b. an intermediate sleeve member extending upwardly from said base member and having an open upper end through which a beverage or food container can be inserted and withdrawn;

c. a cap having a transverse closure member at least partially closing the upper end of said sleeve member and having a downwardly depending skirt configured to fit around the upper periphery of said sleeve member and in contact with said sleeve member to hold said cap member in place;

d. at least one flow channel in said canister comprising at least one opening in the base member of said canister providing for fluid communication between the interior and exterior of said canister through the bottom of said canister;

e. said cap closure member having a central aperture therein and a plurality of slots extending radially outwardly from said central aperture to divide said closure into a plurality of flexible segments to accommodate the insertion and withdrawal of a beverage container.

2. The combination of claim 1 further comprising a plurality of peripheral apertures located adjacent to the outer periphery of said closure member and at the termini of said slots, said peripheral apertures being larger than the width of said slots and smaller than said central aperture.

3. The combination of claim 1 wherein said central aperture of said closure member is provided with a beveled edge slanting outwardly and downwardly within said closure member.

4. The combination of claim 3 wherein said flexible segments are configured to provide a sloping underside which slopes upwardly to provide a reduced dimension at said central aperture.

5. The combination of claim 4 wherein said cap segments are provided with longitudinally-extending ribs on the undersides thereof extending approximately from said skirt to said central aperture.

6. The combination of claim 1 wherein said flow channel comprises at least one opening in the sidewall of said sleeve.

7. In a beverage or food chilling system, the combination comprising:

a. a chilling vessel having a bottom portion and a wall portion extending upwardly from said bottom portion and adapted to contain a cooling medium;

b. a canister adapted to receive a beverage or food container disposed within said cooling vessel, said canister having:

1) a base member adapted to support said canister within said chilling vessel and having an opening therein providing for fluid communication between the interior of said canister and said chilling vessel through the bottom of said canister;

2) an intermediate sleeve member extending upwardly from said base member and having an open upper end through which a beverage or food container can be inserted and withdrawn; and 3) a cap having a transverse closure member at least partially closing the upper end of said sleeve member and in contact with the sleeve member;

c. said sleeve member of said canister being spaced internally from the wall of said chilling vessel to provide a clearance space within which a cooling medium may be contained;

d. a plurality of vertically extending openings in the sleeve member of said canister and spaced peripherally about said canister to provide for fluid communication between said clearance space and the interior of said canister; and e. said cap closure member having a central aperture therein and a plurality of slots extending radially outwardly from said central aperture to divide said closure into a plurality of flexible segments to accommodate the insertion and withdrawal of a beverage container and wherein said sleeve member is of a cylindrical configuration to conform generally to the shape of a wine bottle or the like and further comprising at least one opening at the bottom of said canister and a plurality of vertically extending openings spaced peripherally in the sidewall of said cylindrical sleeve member.

8. The combination of claim 7 wherein said transverse ledge portion of said base member has at least a partially circular configuration.

9. The combination of claim 8 therein said ledge has at least one flattened edge conforming generally to a chord of the outer perimeter of the ledge portion.

10. In a canister adapted to receive a beverage container for insertion into a chilling vessel, the combination comprising:

a. a base member adapted to support said canister within a chilling vessel;

b. an intermediate sleeve member extending upwardly from said base member and having an open upper end through which a beverage container can be inserted and withdrawn;

c. a cap having a transverse closure member and downwardly depending skirt configured to fit around the upper periphery of said sleeve member to hold said cap member in place, said closure member having a central aperture therein of at least 2 cm. and a plurality of slots extending radially outwardly from said central aperture to divide said closure member into a plurality of flexible segments to accommodate the insertion and withdrawal of a beverage container;

d. at least one flow channel in said canister providing for fluid communication between the interior and exterior of said canister.

11. The combination of claim 10 wherein said at least one flow channel comprises a plurality of vertically extending openings spaced peripherally in the side wall of said sleeve member.

12. The combination of claim 11 further comprising a plurality of peripheral apertures located adjacent to the outer periphery of said closure member and at the termini of said slots, said peripheral apertures being larger than the width of said slits and substantially smaller than said central aperture.

13. The combination of claim wherein 12 said central aperture of said closure member is provided with a beveled edge slanting outwardly and downwardly within said closure member.

14. The combination of claim 13 wherein said canister has an internal, upstanding support extending upwardly into the interior of said sleeve adapted to support a beverage or food container inserted within said sleeve to provide a clearance space adjacent to the bottom of said canister.

15. In a beverage or food chilling system, the combination comprising:

a. a chilling vessel having a bottom portion and a wall portion extending upwardly from said bottom portion and adapted to contain a cooling medium;

b. a canister adapted to receive a beverage or food container disposed within said cooling vessel, said canister having:

1) a base member adapted to support said canister within said chilling vessel and having an opening therein providing for fluid communication between the interior of said canister and said chilling vessel;

2) an intermediate sleeve member extending upwardly from said base member and having an open upper end through which a beverage or food container can be inserted and withdrawn; and 3) a cap having a transverse closure member at least partially closing the upper end of said sleeve member and in contact with the sleeve member;

c. said sleeve member of said canister being spaced internally from the wall of said chilling vessel to provide a clearance space within which a cooling medium may be contained; and d. a plurality of vertically extending openings in the sleeve member of said canister and spaced peripherally about said canister to provide for fluid communication between said clearance space and the interior of said canister;

e. said cap having a downwardly depending skirt configured to fit around the upper periphery of said sleeve member to hold said cap member in place, said closure member having a central aperture therein of at least 2 cm. and a plurality of slots extending radially outwardly from said central aperture to divide said closure member into a plurality of flexible segments to accommodate the insertion and withdrawal of a beverage container.

16. The combination of claim 15 further comprising a plurality of peripheral apertures located adjacent to the outer periphery of said closure member and at the termini of said slots, said peripheral apertures being larger than the width of said slits and substantially smaller than said central aperture.

17. The combination of claim 16 wherein said central aperture of said closure member is provided with a beveled edge slanting outwardly and downwardly within said closure member.

18. In a system for maintaining a beverage container, such as a wine bottle, in a chilled condition, the combination comprising:

(a) a chilling vessel having a bottom portion and a wall portion extending upwardly from said bottom portion and adapted to contain ice as a cooling medium;

(b) a canister located within the interior of said chilling vessel and having a base member supporting said canister within said chilling vessel;

(c) an intermediate sleeve member extending upwardly from said base member and having an open upper end through which a beverage or food container can be inserted and withdrawn;

(d) a cap having a transverse closure member partially closing the upper end of said sleeve member and having a plurality of radial flexible segments to accommodate the insertion and withdrawal of a beverage container, said cap having a downwardly depending skirt configured to fit around the upper periphery of said sleeve member and in contact with said sleeve member to hold said cap in place; and (e) at least one flow channel in said canister providing for fluid communication between the interior and exterior of said canister;

(f) said sleeve member being spaced from the interior surface of said chilling vessel to provide a clearance space to provide for the accumulation of ice surrounding said sleeve member.

19. The combination of claim 18 wherein said flexible segments are defined by a central aperture in said transverse closure member adapted to fit around the neck of a wine bottle when placed within said sleeve member and a plurality of slots in said closure member extending outwardly from said closure member whereby as a wine bottle is withdrawn from said sleeve member, the flexible segments are moved upwardly so that ice may be shed away from the wine bottle.

20. The combination of claim 19 further comprising a plurality of longitudinally-extending ribs which are provided on the surfaces of the flexible segments of said closure member extending outwardly from said central aperture to provide rigidity to said flexible members.

21. The combination of claim 20 further comprising a plurality of peripheral apertures located adjacent to the outer periphery of said closure member and at the termini of said slots, said peripheral apertures being larger than the width of said slots and smaller than said central aperture.

* * * * *